US007155946B2

(12) United States Patent
Lee et al.

(10) Patent No.: US 7,155,946 B2
(45) Date of Patent: Jan. 2, 2007

(54) MORTISE LOCK HAVING DOUBLE LOCKING FUNCTION

(75) Inventors: Sang-Han Lee, Seoul (KR); Jin-Sub Shin, Seoul (KR)

(73) Assignee: Seoul Commtech Co. Ltd. (KR)

( * ) Notice: Subject to any disclaimer, the term of this patent is extended or adjusted under 35 U.S.C. 154(b) by 0 days.

(21) Appl. No.: 11/250,766

(22) Filed: Oct. 14, 2005

(65) Prior Publication Data

US 2006/0266088 A1 Nov. 30, 2006

(30) Foreign Application Priority Data

May 30, 2005 (KR) ..... 10-2005-0045724

(51) Int. Cl.
*E05B 59/00* (2006.01)
*E05B 63/00* (2006.01)

(52) U.S. Cl. ..... 70/107; 70/110; 292/34; 292/36; 292/169.14; 292/169.17; 292/DIG. 26

(58) Field of Classification Search ..... 70/472, 70/218, 107–111, 149; 292/169.14, 36, 169.15, 292/34, DIG. 26–DIG. 27, 169.17
See application file for complete search history.

(56) References Cited

U.S. PATENT DOCUMENTS 155,181 A * 9/1874 Cook ..... 70/336
535,791 A * 3/1895 Dies ..... 70/107
689,334 A * 12/1901 Taylor ..... 292/169.15
3,148,524 A * 9/1964 Yulkowski ..... 70/107
3,769,822 A * 11/1973 Yulkowski ..... 70/107
5,027,625 A * 7/1991 Krachten ..... 70/107
5,083,448 A * 1/1992 Karkkainen et al. ..... 70/277
6,393,878 B1 5/2002 Fayngersh et al.

FOREIGN PATENT DOCUMENTS

KR 1020030093752 12/2003

* cited by examiner

*Primary Examiner*—Lloyd A. Gall
(74) *Attorney, Agent, or Firm*—Cantor Colburn LLP

(57) ABSTRACT

A mortise lock having a double locking function is provided, which includes: a deadbolt for performing a locking function of a door by going in and out the door; a latchbolt going in and out the door by a handle installed on the door; and a locking member for maintaining the latchbolt in a locked state by keeping the latchbolt projected when the deadbolt is projected, whereby it is possible to improve the security, and reducing breakage and malfunction of the deadbolt due to forced operations of the door, since the door employing the mortise lock cannot be forcedly opened without breaking the latchbolt as well as the deadbolt.

10 Claims, 6 Drawing Sheets

MORTISE LOCK HAVING DOUBLE LOCKING FUNCTION

CROSS-REFERENCE TO RELATED APPLICATION

This application claims the benefit of Korean Patent Application No. 2005-45724, filed May 30, 2005, the disclosure of which is hereby incorporated herein by reference in its entirety.

BACKGROUND OF THE INVENTION

1. Field of the Invention

The present invention relates to a mortise lock and, more particularly, to a mortise lock having a double locking function that a latchbolt is also locked together with locking of a deadbolt.

2. Description of the Related Art

Generally, a mortise lock, which is installed on various kinds of doors, includes a deadbolt and a latchbolt. The deadbolt has a locking function, and the latchbolt is moved by a door handle to go in and out the door. A conventional mortise lock is disclosed in U.S. Pat. No. 6,393,878, WO 01/42600, and so on.

The deadbolt of the conventional mortise lock performs a manual locking function by a user or an automatic locking function. On the other hand, the latchbolt simply goes in and out. Therefore, the mortise lock causes security problems since an invader can readily open a door by forcedly breaking the deadbolt only, while the mortise lock is required to provide security.

In addition, the conventional mortise lock may not perform an effective locking function due to sagging or distortion of the door after several months of installation. Moreover, the deadbolt and the latchbolt typically have a small step therebetween. Therefore, when a user pulls the door to determine whether the door is locked or not after rotating the door, the door is pulled by a length of the step to cause the deadbolt to be damaged so that the door may be malfunctioned or broken.

SUMMARY OF THE INVENTION

In order to solve the foregoing and/or other problems, it is an aspect of the present invention to provide a mortise lock having a double locking function that a latchbolt is also locked together with locking of a deadbolt.

It is another aspect of the present invention to provide a mortise lock having a double locking function that the deadbolt can be operated only when the latchbolt is normally operated.

Additional aspect and advantages of the present invention will be set forth in part in the description which follows and, in part, will be obvious from the description, or may be learned by practice of the invention.

The foregoing and/or other aspects of the present invention may be achieved by providing a mortise lock including: a deadbolt for performing a locking function of a door by going in and out the door; a latchbolt going in and out the door by a handle installed on the door; and a locking member for maintaining the latchbolt in a locked state by keeping the latchbolt projected when the deadbolt is projected.

Preferably, the locking member includes a locking rotator rotated by the deadbolt, when the deadbolt goes out, to be hooked at a rear portion of the latchbolt.

In addition, preferably, the door includes a case having the locking rotator located therein, and the latchbolt includes an exposed part exposed to the exterior of the case, and a sliding part located in the case and integrally formed with the exposed part.

In addition, preferably, the case includes a latch slide located therein to support movement of the sliding part and reciprocated by the handle; and a hook rotatably installed at the latch slide to be hooked by the latchbolt when the deadbolt is inserted into the case.

In addition, preferably, the hook has a guide protrusion formed at its one side to allow the hook to be released from the sliding part of the latchbolt when the locking rotator is rotated in a locking direction.

In addition, preferably, the hook is resiliently supported toward the latch slide by a spring.

In addition, preferably, the locking rotator includes a locking protrusion which is in contact with the deadbolt, hinged to the case at its middle portion, and protruded from its one end to go in and out the sliding part of the latchbolt.

In addition, preferably, the deadbolt includes a contact part projected from its one side to be in contact with the locking rotator.

In addition, preferably, the sliding part is provided with one end supported by the sliding part, and the other end equipped with a spring supported by a supporter installed at the case.

Another aspect of the present invention may be achieved by providing a mortise lock including: a case located in a door; a deadbolt for performing a locking function of the door by going in and out the door; a latchbolt having an exposed part going in and out the door by a handle installed on the door, and a sliding part located in the case and integrally formed with the exposed part; and a locking rotator installed in the case and rotatable by the deadbolt to be hooked at the sliding part of the latchbolt in order to maintain the latchbolt in a locked state by keeping the latchbolt projected when the deadbolt is projected.

In addition, the case includes a latch slide located therein to support movement of the sliding part and reciprocated by the handle; and a hook rotatably installed at the latch slide to be hooked by the sliding part of the latchbolt when the deadbolt is inserted into the case.

In addition, preferably, the hook has a guide protrusion formed at its one side to allow the hook to be released from the sliding part of the latchbolt when the locking rotator is rotated in a locking direction, and the hook is resiliently supported toward the latch slide by a spring.

In addition, preferably, the locking rotator includes a locking protrusion which is in contact with a contact part projected from one side of the deadbolt, hinged to the case at its middle portion, and protruded from its one end to go in and out the sliding part of the latchbolt.

In addition, preferably, the sliding part is provided with one end supported by the sliding part, and the other end equipped with a spring supported by a supporter installed at the case.

Yet another aspect of the present invention may be achieved by providing a mortise lock including: a case located in a door; a deadbolt for performing a locking function of the door by going in and out the door; a latchbolt having an exposed part going in and out the door by a handle installed on the door, and a sliding part located in the case and integrally formed with the exposed part; a locking rotator installed in the case and rotatable by the deadbolt to be hooked at the sliding part of the latchbolt in order to maintain the latchbolt in a locked state by keeping the latchbolt projected when the deadbolt is projected; a latch slide installed in the case, supporting movement of the sliding part, and reciprocated by the handle; and a hook rotatably installed at the latch slide to be hooked by the latchbolt when the deadbolt is inserted into the case.

Preferably, the hook has a guide protrusion formed at its one side to allow the hook to be released from the sliding part of the latchbolt when the locking rotator is rotated in a locking direction.

In addition, preferably, the hook is resiliently supported into the sliding part of the latchbolt by a spring.

In addition, preferably, the locking rotator includes a locking protrusion which is in contact with a contact part formed at the deadbolt, hinged to the case at its middle portion, and protruded from its one end to go in and out the sliding part of the latchbolt.

In addition, preferably, the sliding part is provided with one end supported by the sliding part, and the other end equipped with a spring supported by a supporter installed at the case. dr

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE INVENTION

Figure 1:
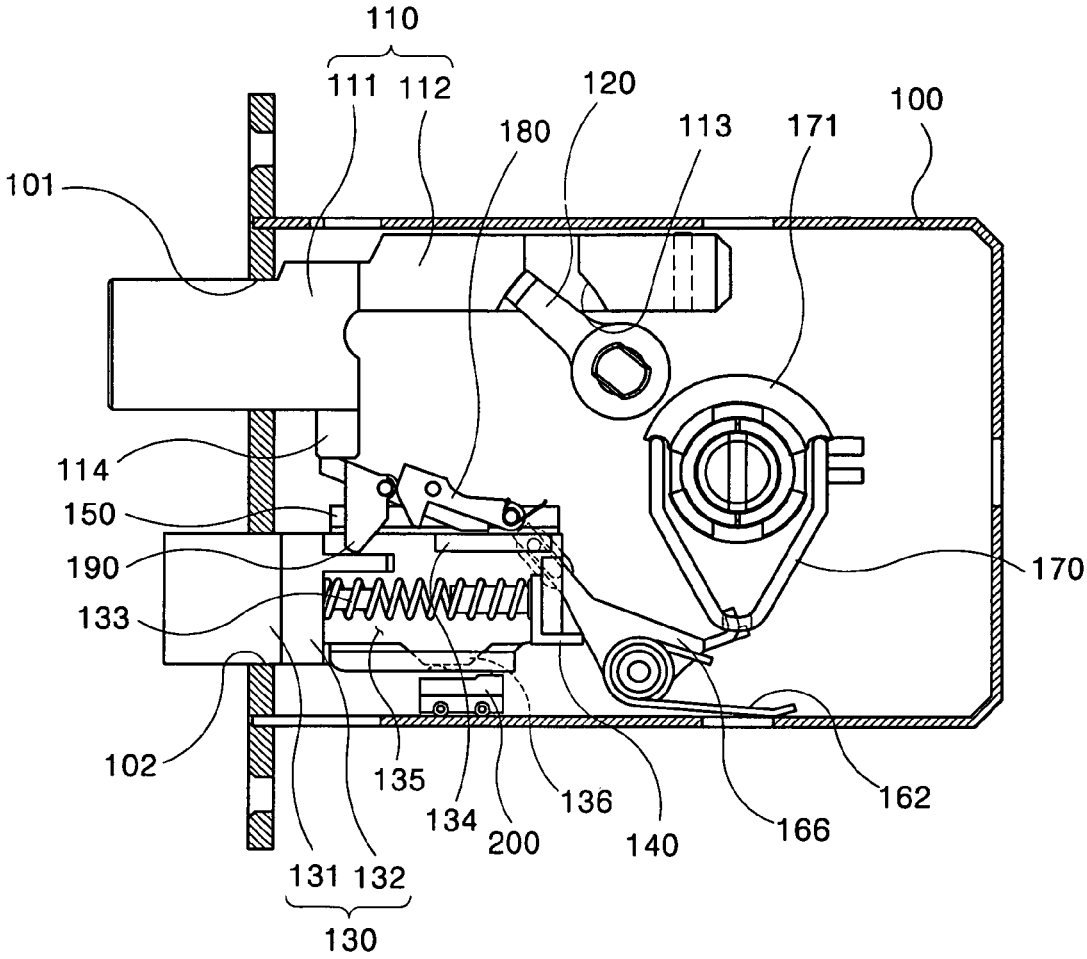
FIG. 1 is a side cross-sectional view illustrating a double locking state of a mortise lock in accordance with an embodiment of the present invention.

Reference will now be made in detail to a mortise lock of in accordance with an embodiment of the present invention, examples of which are illustrated in the accompanying drawings, wherein like reference numerals refer to the like elements throughout. The embodiments are described below in order to explain the present invention by referring to the figures.

Figure 2:
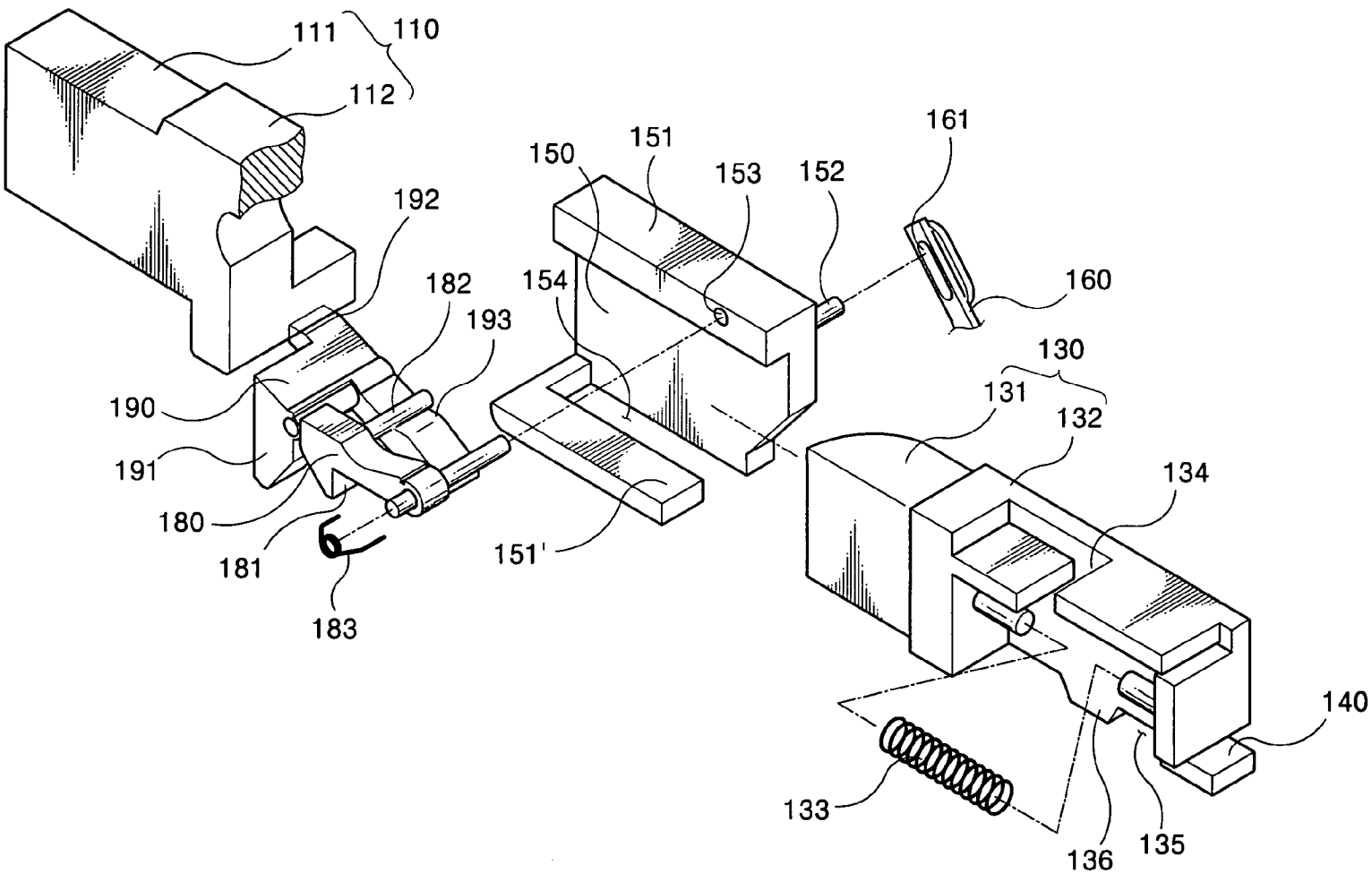
FIG. 2 is an exploded perspective view illustrating an assembled state of a deadbolt and a latchbolt of the mortise lock having a double locking function in accordance with an embodiment of the present invention.

As shown in FIGS. 1 and 2, a mortise lock in accordance with an embodiment of the present invention includes a case 100 installed on a door (not shown). The case 100 includes a deadbolt 110 installed therein to go in and out the case 100.

The deadbolt 110 includes an exposed part 111 going in and out through a first access hole 101 formed at a side of the case 100, and a sliding part 112 integrally formed with the exposed part 111 and located in the case 100. The sliding part 112 has a semi-circular operating groove 113.

A rotary lever 120 is rotatably installed in the case to be rotated by a drive means such as a motor or user, and a distal end of the rotary lever 120 is located in the operating groove 113. Therefore, the exposed part 111 of the deadbolt 110 goes in or out the case 100 depending on the rotational direction of the rotary lever 120. In addition, the deadbolt 110 has a contact part 114 extending downward from a side lower portion of the exposed part 111.

A latchbolt 130 is installed under the deadbolt 110. The latchbolt 130 includes an exposed part 131 going in and out through a second access hole 102 formed under the first access hole 101, and a sliding part 132 integrally formed with the exposed part 131 and located in the case 100.

A spring 133 installed in the sliding part 132 of the latchbolt 130 is provided with one end supported by a left inner wall of the sliding part 132 and the other end supported by a supporting wall 140 fixed in the case 100 to extend into the sliding part 132. A sliding groove 135 is formed at a lower surface of the sliding part 132 to allow the latchbolt 130 to be moved in a forward or backward direction of the supporting wall 140. A laterally elongated stopper projection 134 is formed at an upper surface of the sliding part 132.

Meanwhile, the sliding part 132 of the latchbolt 130 is supported by a latch slide 150 installed in the case 100. The latch slide 150 is also slidably installed in the case 100. The latch slide 150 has sliding projections 151 and 151' respectively formed at its upper and lower ends, and a drive shaft 152 protruded outward from a right side end. In addition, a supporting hole 153 is formed at the sliding projection 151 above the drive shaft 152.

A pressing end 136 is formed at a lower part of the sliding part 132 of the latchbolt 130 to be moved along a guide groove 154 formed at the latch slide 150, and a micro switch 200 is installed under the pressing part 136 to detect an operation state of the latchbolt 130 according to the movement of the pressing end 136.

A rotator 160 is installed behind the latchbolt 130 to allow the latchbolt 130 to be moved forward or backward by the handle. An elongated hole 161 is formed at a left end of the rotator 160 so that the drive shaft 152 passes through the hole 161 to be slidably moved therein.

In addition, a middle part of the rotator 160 is rotatably hinged at the case 100, and a torsion spring 162 is installed on the hinged part. The torsion spring 162 has one end supported by a lower sidewall of the case 100 and the other end resiliently supporting upward a right end of the rotator 160.

A power transmission member 170 is installed at the right end of the rotator 160 to rotate the rotator 160 or to be recovered upward by the rotator 160. The power transmission member 170 is located in the case 100 and supported by both side ends of a rotary cam 171 which has a fan shape and is laterally rotated by a handle (not shown).

Meanwhile, a hook 180 installed in the supporting hole 153 of the latch slide 150 includes one end rotatably hinged at the supporting hole 153 and the other end having a hooking protrusion 181 protruded downward to be hooked by the stopper projection 134 formed at the sliding part 132 of the latchbolt 130. A torsion spring 183 is installed on the hinged part to resiliently support the hook 180 downward.

In addition, the hook 180 includes a guide protrusion 182 protruded sideward from its left side surface. A locking member is installed under the guide protrusion 182 to be rotated by the contact part 114 of the deadbolt 110 when the guide protrusion 182 is in contact with the locking member.

The locking member is a locking rotator 190 rotatably hinged at the case 100 and having a locking protrusion 191 protruded downward from its left side end. A contact end 192 is formed at an upper end of the locking protrusion 191 to be in contact with the contact part 114 of the deadbolt 110. In addition, a guide surface 193 is formed at a right end of the locking rotator 190 to guide sliding movement of the guide protrusion 182.

Hereinafter, Operation of a mortise lock in accordance with an embodiment of the present invention will be described.

Figure 3:
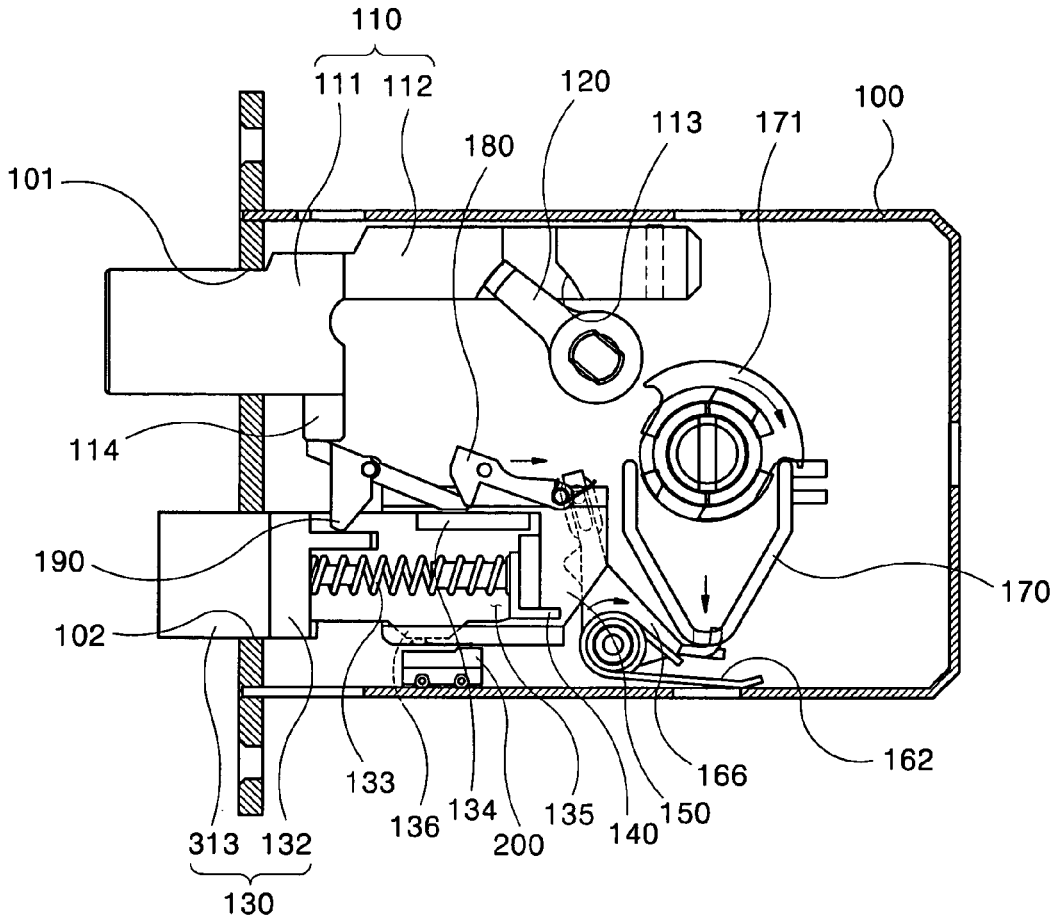
FIG. 3 is a side cross-sectional view illustrating a state that a handle is operated in the double locking state of the mortise lock in accordance with an embodiment of the present invention.

FIG. 1 illustrates a double locked state, and FIG. 3 illustrates a state when the handle is rotated from the state of FIG. 1.

As shown in FIGS. 1 and 3, when the rotary lever 120 is rotated left, the deadbolt 110 goes out through the first access hole 101. A basic locking state is in this state that the exposed part 111 of the deadbolt 110 is projected.

In this state, as the deadbolt 110 moves left, the contact part 114 of the deadbolt 110 pushes the contact end 192 of the locking rotator 190. Thus, the locking rotator 190 is rotated downward, and then the locking protrusion 191 is moved downward to support the left side end of the sliding part 132 of the latchbolt 130, thereby preventing the latchbolt. 130 from moving backward.

At this time, the contact end 192 of the rotating rotator 190 is raised to push the guide protrusion 182 of the hook 180 upward. Therefore, the hooking protrusion 181 of the hook 180 is not supported on the sliding part 132 of the latchbolt 130.

As shown in FIG. 3, when a user operates the handle (not shown), the rotary cam 171 is rotated in the operating direction of the handle, and the power transmission member 170 is lowered regardless of the rotational direction of the rotary cam 171. When the power transmission member 170 is lowered 170, the rotator 160 is rotated rightward; as a result, the latch slide 150 is pulled by the rotator 160 to slide rightward.

At this time, the hook 180 is in a state raised by the guide surface 193 of the locking rotator 190. Therefore, when the latch slide 150 is moved rightward, the latchbolt 130 remains in a stopped state, without moving together with the latch slide 150. Therefore, in spite of the operation of the handle, the exposed part 131 of the latchbolt 130 maintains the projected state, without going in through the second access hole 102, thereby maintaining the locked state.

Figure 4:
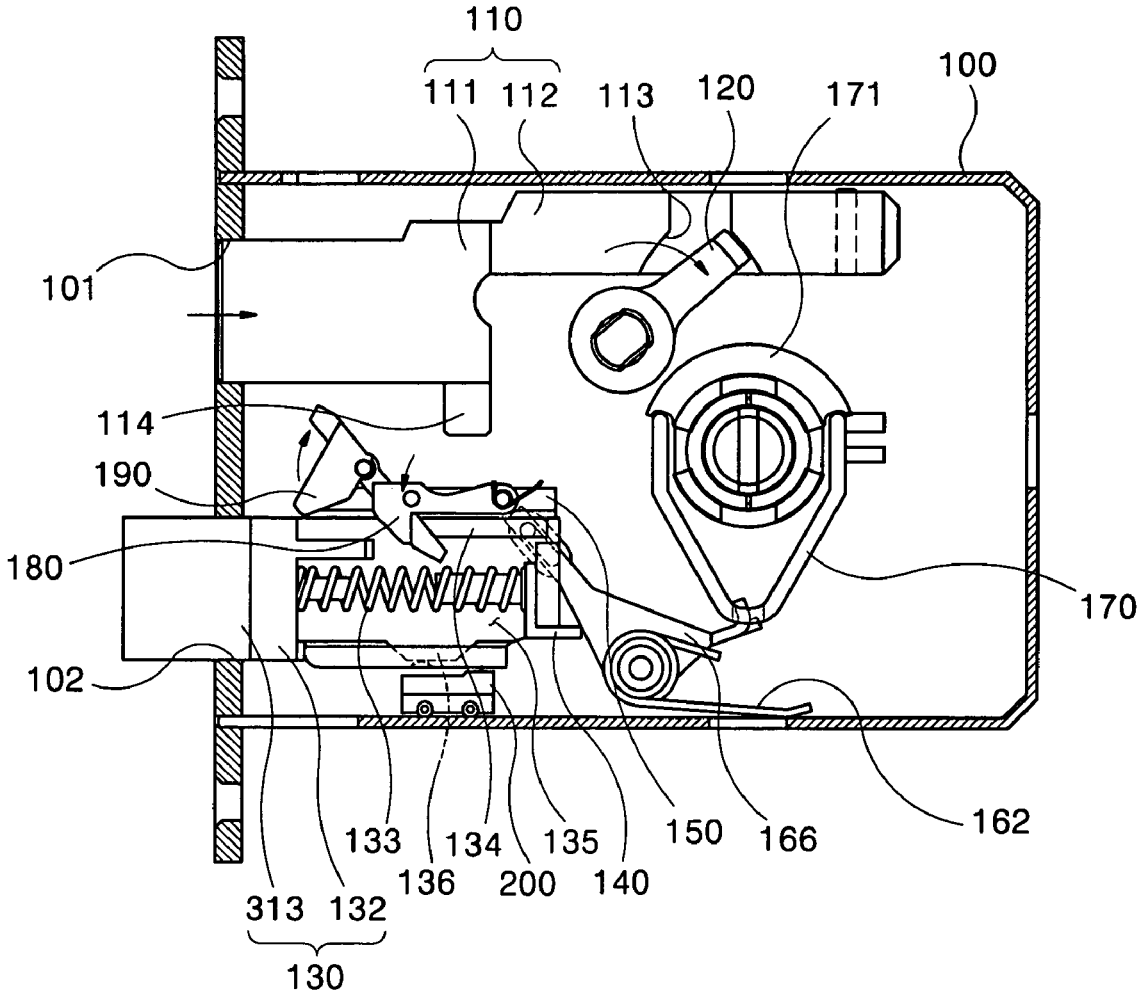
FIG. 4 is a side cross-sectional view illustrating a released state of the mortise lock in accordance with an embodiment of the present invention.

Meanwhile, FIG. 4 illustrates that the deadbolt 110 is in a released state. As shown in FIG. 4, when the rotary lever 120 is rotated rightward using a drive means such as a motor, an end of the rotary lever 120 is pivoted rightward from the interior of the operating groove 113 of the deadbolt 110 to allow the exposed part 111 of the deadbolt 110 to be inserted into the case 100, thereby releasing the locked state of the deadbolt 110.

At this time, as the deadbolt 110 moves rightward, the contact part 114 of the deadbolt 110 also moves rightward. As a result, the contact end 192 of the locking rotator 190 is rotated clockwise by the guide protrusion 182 of the hook 180 since there is no external force applying to the contact end 192. At this time, the rotational force is provided by the torsion spring 183 resiliently supporting the hook 180. At the same time, the hook 180 is rotated counterclockwise, and thus the hooking protrusion 181 of the hook 180 is inserted into the hooking projection 134 formed at the sliding part 132 of the latchbolt 130 to be hooked by the hooking projection 134.

Figure 5:
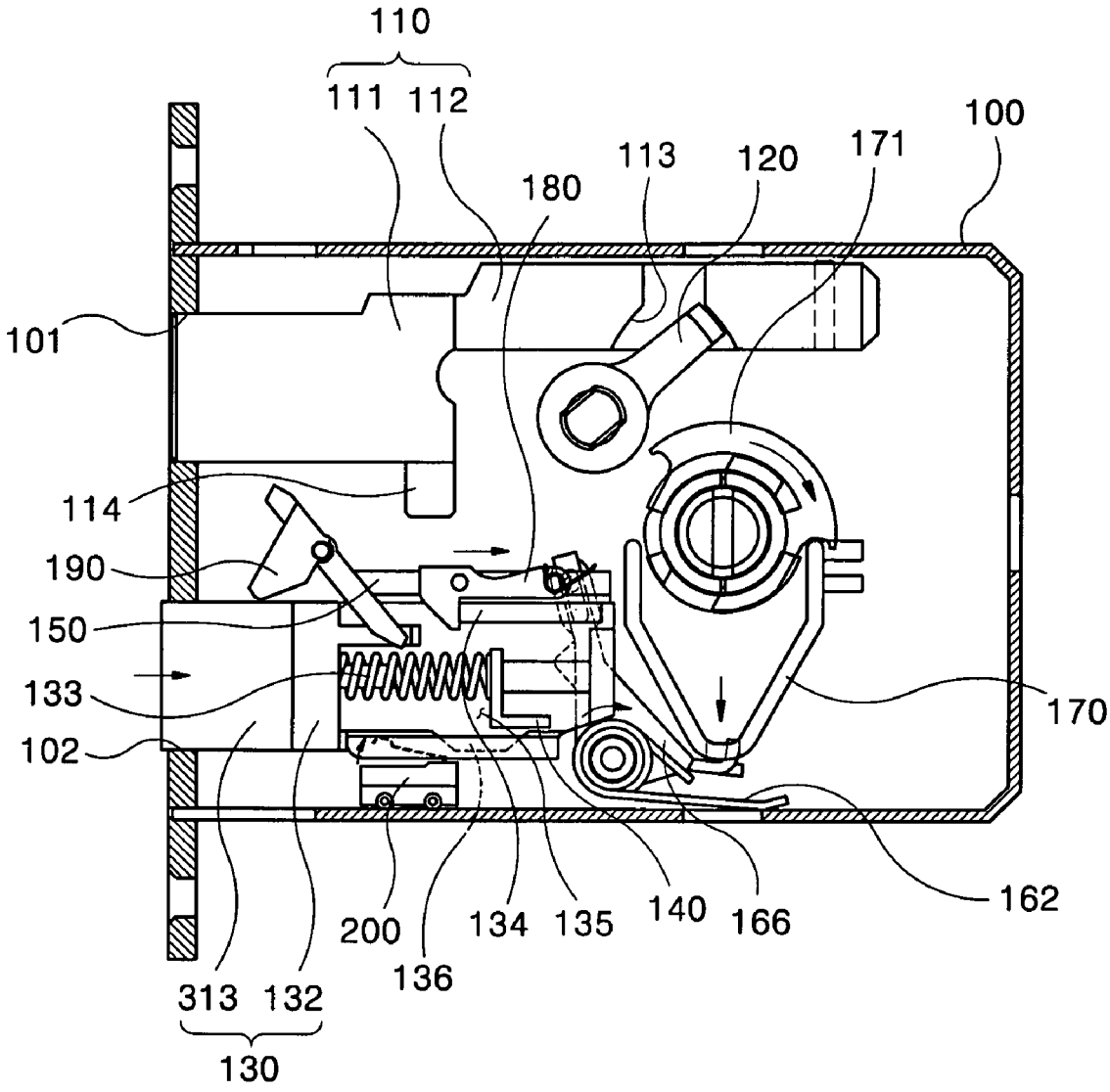
FIG. 5 is a side cross-sectional view illustrating a state that the handle is operated in the released state of the mortise lock in accordance with an embodiment of the present invention.

In this state, as shown in FIG. 5, when the handle is rotated, the rotary cam 171 is rotated in an operated direction of the handle, and the power transmission part 170 is lowered, regardless of the rotational direction of the rotary cam 171. When the power transmission member 170 is lowered, the rotator 160 is rotated rightward, and thus the drive shaft 152 of the latch slide 150 moves along the elongated hole 161 so that the latch slide 150 is pulled by the rotator 160 to slide rightward.

At this time, the hook 180 is in a state hooked by the sliding part 132 of the latchbolt 130. Therefore, when the latch slide 150 moves rightward, the latchbolt 130 moves rightward together with the latch slide 150. That is, the latchbolt 130 is inserted into the case 100 through the second access hole 102. Therefore, when the handle is operated, the latchbolt 130 is also operated, thereby providing an open state. Then, when the handle is released, all of the components are recovered to their original states by the torsion spring 162.

Figure 6:
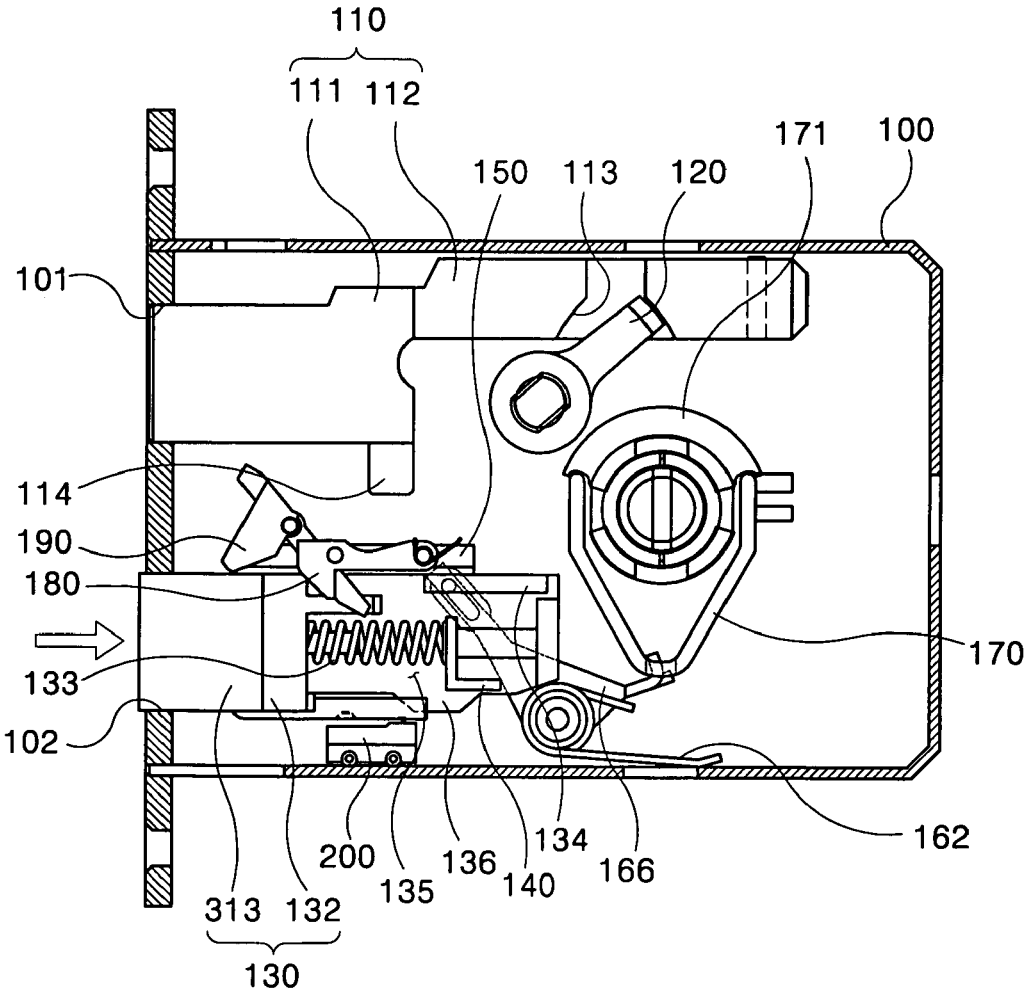
FIG. 6 is a side cross-sectional view illustrating a state that the mortise lock in accordance with an embodiment of the present invention is released from a locked state and the latchbolt is operated by an external force.

As shown in FIG. 6, when an external force is applied to the exposed part 131 of the latchbolt 130, without rotating the handle, the latch slide 150 is not operated, and only the latchbolt 130 is operated. That is, the sliding part 132 of the latchbolt 130 is inserted into the door to push the spring 133 supported between the sliding part 132 and the supporting wall 140, thereby compressing the spring 133. Therefore, when the external force applied to the exposed part 131 of the latchbolt 130 is removed, the latchbolt 130 is recovered to its original position by a recovering force of the spring 133.

As described above, the mortise lock in accordance with the present invention performs the double locking function that the latchbolt 130 is locked together with the deadbolt 110 when the deadbolt 110 is locked, and the latchbolt 130 is typically operated by the handle when the deadbolt 110 is opened.

Meanwhile, it is possible to control the deadbolt 110 such that the deadbolt 110 is operated only when the latchbolt 130 is normally projected. That is, when the deadbolt 110 is controlled by a drive means as a motor and a controller for controlling the drive means, the pressing end 136 of the latchbolt 130 is in contact with a micro switch 200 disposed under the latchbolt 130 to detect an operation of the latchbolt 130, which will be understood with reference to FIGS. 1 to 5. Therefore, it is possible to prevent a malfunction of the deadbolt 110 by allowing the deadbolt to be operated only when the latchbolt 130 is normally operated.

As can be seen from the foregoing, since the door employing the mortise lock in accordance with the present invention cannot be forcedly opened without breaking the latchbolt as well as the deadbolt, it is possible to improve the security, reducing breakage and malfunction of the deadbolt due to forced operations of the door, and preventing the deadbolt from being out of order by controlling an operation of the deadbolt depending on whether the latchbolt is normally operated or not.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A mortise lock comprising:

a deadbolt for performing a locking function of a door by going in and out the door;

a latchbolt going in and out the door by a handle installed on the door; and a locking member for maintaining the latchbolt in a locked state by keeping the latchbolt projected when the deadbolt is projected;

wherein the locking member comprises a locking rotator rotated by the deadbolt, when the deadbolt goes out, to be hooked at a rear portion of the latchbolt;

wherein the door comprises a case having the locking rotator located therein;

wherein the latchbolt includes an exposed part exposed to the exterior of the case, and a sliding part located in the case and integrally formed with the exposed part;

wherein the case comprises:

a latch slide located therein to support movement of the sliding part and reciprocated by operation of the handle; and a hook rotatably hinged to the latch slide to be hooked with the latchbolt when the deadbolt is inserted into the case; and wherein the locking rotator comprises a locking protrusion which is in contact with the deadbolt, hinged to the case at its middle portion, and protruded from its one end to go in and out the sliding part of the latchbolt.

2. The mortise lock according to claim 1, wherein the hook has a guide protrusion protruded towards the latch slide to allow the hook to be released from the sliding part of the latchbolt when the locking rotator is rotated in a locking direction.

3. The mortise lock according to claim 2, wherein the hook is resiliently supported toward the latch slide by a spring.

4. The mortise lock according to claim 1, wherein the deadbolt comprises a contact part projected from its one side to be in contact with the locking rotator.

5. The mortise lock according to claim 1, wherein the sliding part is provided with one end supported by the latch, and the other end equipped with a spring supported by a supporter installed in the case.

6. The mortise lock according to claim 1, further comprising a switch installed under the latchbolt to detect an operation of the latchbolt.

7. A mortise lock comprising:

a case located in a door;

a deadbolt for performing a locking function of the door by the deadbolt going in and out the door;

a latchbolt having an exposed part going in and out the door by operating a handle installed on the door, and a sliding part located in the case and integrally formed with the exposed part; and a locking rotator configured to be contacted by the deadbolt such that the locking rotator is hooked with the sliding part of the latchbolt in order to maintain the latchbolt in a locked state by keeping the latchbolt projected when the deadbolt is projected;

wherein the case comprises:

a latch slide located therein to support movement of the sliding part and reciprocated by operation of the handle; and a hook rotatably hinged to the latch slide to be hooked with the sliding part of the latchbolt when the deadbolt is inserted into the case; and wherein the locking rotator comprises a locking protrusion which is in contact with a contact part projected from one side of the deadbolt, hinged to the case at its middle portion, and protruded from its one end to go in and out the sliding latchbolt.

8. The mortise lock according to claim 7, wherein the hook has a guide protrusion protruded towards the latch slide to allow the hook to be released from the sliding part of the latchbolt when the locking rotator is rotated in a locking direction, and the hook is resiliently supported toward the latch slide by a spring.

9. The mortise lock according to claim 7, wherein the sliding part is provided with one end supported by the latch slide, and the other end equipped with a spring supported by a supporter installed in the case.

10. The mortise lock according to claim 7, further comprising a switch installed in the case to detect an operation of the latchbolt.

* * * * *